US005865976A

United States Patent [19]

Takeuchi et al.

[11] Patent Number: 5,865,976

[45] Date of Patent: Feb. 2, 1999

[54] PLATING METHOD

[75] Inventors: Hiromitsu Takeuchi, Inazawa; Yoshiki Tsunekawa, Okazaki; Masahiro Okumiya, Nagoya, all of Japan

[73] Assignee: Toyoda Gosei Co., Inc., Aichi-ken, Japan

[21] Appl. No.: 788,977

[22] Filed: Jan. 24, 1997

Related U.S. Application Data

[63] Continuation-in-part of Ser. No. 539,904, Oct. 6, 1995, Pat. No. 5,651,872.

[30] Foreign Application Priority Data

| | | | |
|---|---|---|---|
| Oct. 7, 1994 | [JP] | Japan | 6-244393 |
| Jan. 24, 1996 | [JP] | Japan | 8-010242 |
| Mar. 27, 1996 | [JP] | Japan | 8-072137 |
| Jun. 24, 1996 | [JP] | Japan | 8-163088 |
| Jan. 9, 1997 | [JP] | Japan | 9-002408 |

[51] Int. Cl.[6] ..... C25D 5/08

[52] U.S. Cl. ..... 205/109; 205/112; 205/133; 205/176; 427/466; 427/470

[58] Field of Search ..... 205/84, 98, 109, 205/112, 133, 170, 172, 176, 181, 187, 261, 271, 273, 89; 427/454, 405, 436, 258, 470, 466

[56] References Cited

U.S. PATENT DOCUMENTS

| | | | |
|---|---|---|---|
| 3,981,781 | 9/1976 | Mori et al. | 205/109 |
| 4,111,761 | 9/1978 | Laboda | 205/132 |
| 4,498,967 | 2/1985 | Paulet et al. | 204/272 |
| 5,441,629 | 8/1995 | Kosaki | 205/148 |
| 5,496,463 | 3/1996 | Mori et al. | 205/109 |
| 5,520,791 | 5/1996 | Murase | 205/50 |
| 5,540,829 | 7/1996 | Mase et al. | 205/109 |

FOREIGN PATENT DOCUMENTS

| | | |
|---|---|---|
| 0 709 493 | 5/1906 | European Pat. Off. . |
| 0 108 035 A1 | 5/1984 | European Pat. Off. . |
| 0 641 872 A1 | 3/1995 | European Pat. Off. . |
| 52070945 | 6/1977 | Japan . |
| 54017299 | 6/1979 | Japan . |
| 5-148689 | 6/1993 | Japan . |
| 5148689 | 6/1993 | Japan . |
| 7-157899 | 6/1995 | Japan . |
| 7-188994 | 7/1995 | Japan . |
| 7-278879 | 10/1995 | Japan . |

OTHER PUBLICATIONS

Chemical Abstracts –abstract of Kawasaki et al., Kinzoku Hyomen Gijutsu, 1973, 24(4), 196–202, Month Unavailable.

Chemical Abstracts–abstract of Hayashi et al., Interfinish 76, Tagungsberichtsband–Weltongr. Oberflaechenbehandl. Met., 9th (1976), Paper No. 18, 14 pp., Month Unavailable.

Chemical Abstracts–abstract of Ishimori et al. Kinzoku Hyomen Gijutsu, 1977, 28(10), 508–512, Month Unavailable.

Chemical Abstracts–abstract of Perene et al., Tagungsband–Kammer Tewch. Suhl (1984), 74, 55–62, Month Unavailable.

(List continued on next page.)

*Primary Examiner*—Robert J. Warden
*Assistant Examiner*—Alex Naguerda
*Attorney, Agent, or Firm*—Cushman Darby & Darby, IP Group of Pillsbury Madison & Sutro LLP

[57] ABSTRACT

A method of making a composite structure including at least a plating film disposed on a substrate having at least a surface portion formed from a metallic base material. The method includes the steps of discharging a composite plating solution containing insoluble particles from a nozzle and impacting the composite plating solution on the surface portion of the substrate at a predetermined flow rate. During at least a portion of the discharging and impacting steps, the surface portion of the substrate is abraded with the insoluble particles in the plating solution discharged from the nozzle. A voltage can be applied between the base material and the nozzle, which are electrically connected by the plating solution, to thereby deposit a plating film on the surface portion of the substrate by electroplating.

14 Claims, 9 Drawing Sheets

OTHER PUBLICATIONS

Tomaszewski et al., Codeposition of Finely Dispersed Particles with Metals, Plating, 1969, 1234–1239, Month Unavailable.

"Handbuch Der Galvanotechnik", Dr. Heinz W. Dettner und Dr. Johannes Elze, Munich 1964, p. 740, (Extract Translation attached).

CAPLUS abstract of JP54017299 (Inoue et al.), Jun. 28, 1979.

Kawasaki et al., "Electroplating of Nickel by Jet Flow ethod of Electrolysis: Studies on High Speed Electroplating", Kinzoku Hyomen Gijutsu, 1973, 24(4), 196–202), Month Unavailable.

Ishimori et al., "Development of Wear–resitant Nickel–Silicon Carbide Composite Coatings", Kinzoku Hyomen Gijutsu, 1977, 28(10),508–512), Month Unavailable.

CAPLUS abstract of JP52070945 (Inoue et al.), Jun. 13, 1977.

PLATING METHOD

CROSS REFERENCES TO RELATED APPLICATIONS

This application is a continuation in part application of U.S. patent application Ser. No. 08/539,904 filed on Oct. 6, 1995, now U.S. Pat. No. 5,651,872, entitled COMPOSITE PLATING METHOD, the complete disclosure of which is incorporated herein by reference.

Plating methods are also disclosed in the following priority patent applications: application no. 8-10242, filed on Jan. 24, 1996 in Japan; application no. 8-72137, filed on Mar. 27, 1996 in Japan; application no. 8-163088, filed on Jun. 24, 1996 in Japan; and application No. 9-2408, filed on Jan. 7, 1997 in Japan. The complete disclosures of each of these priority patent applications are incorporated herein by reference.

BACKGROUND OF THE INVENTION

1. Field of the Invention

The present invention relates to a plating method for forming a composite structure including a plating film on a metal base substrate, and in particular to composite structures suitable for use as or as components in car bumpers, rear-view mirrors, reflectors, electric and electronic parts, precision machine parts, air plane parts, engine pistons, bus-bars, electrical cables, and the like.

2. Description of the Related Art

The preparation of various products by plating substrates prepared from iron and aluminum base materials with a plating film is well known in the art. According to conventional processes, the plating step is typically preceded by pretreatment of the metallic base material which forms the substrate. The pretreatment usually involves removing oxide film and stains from the surface of the material. Oxide films adversely deteriorate the adhesive strength between the metallic base material and the plating film; therefore, removal of the oxide films by pretreatment improves the adhesive strength between the plating film and the metallic base material.

Aluminum base material is more likely to be oxidized by air and develop an oxide film thereon than most other metal base materials. However, even if an oxide film is removed from the surface of aluminum material, the surface will re-oxidize during the plating process and adversely affect the adhesive strength between the metallic base material substrate and the plating film.

To avoid the above drawback, especially in relation to substrates formed from aluminum base materials, a zinc immersion process has been used for preventing re-oxidization of aluminum base materials. The zinc immersion process is usually performed as follows. First, the surface of an aluminum base material is degreased by solvent degreasing and alkaline degreasing. Then, the surface of the material is etched with an etchant. The principal component of the etchant is sodium hydroxide. Since the etched base material contains various kinds of impurities, copper and magnesium smuts or stains are prone to be formed on the surface. The smuts need to be removed for the plating film to adhere well to the base material. A smut removing treatment is thus performed on the base material with an acid such as an acid selected from the group consisting of nitric acid, hydrofluoric acid and sulfuric acid.

Once the smuts are removed from the aluminum base material by acid treatment, the treated aluminum base material is subjected to a zinc immersion process (or a zinc alloy immersion process). In this immersion process, the base material is processed in a zinc immersion solution. The principal component of the solution is sodium hydroxide and zinc oxide. This process removes the thin oxide film on the surface of the base material and forms a zinc film on the exposed surface. The formed zinc film is removed with nitric acid. The base material is then subjected to another immersion process, which forms a zinc film having a more uniform thickness.

After performing each of the above-mentioned pretreatment steps, the aluminum base material covered with the zinc film is subjected to a known electroplating process. In the electroplating process, the base material is immersed in a plating solution and a voltage is applied between electrodes. This forms an electroplating film on the surface of the base material.

As is apparent from the foregoing description, the above-described conventional plating method requires many steps (often more than ten steps, including the pretreatment and the electroplating) for forming a plating film having a sufficient peel strength (or delamination strength) on the surface of the base material substrate. The large number of steps associated with this conventional plating method complicates the plating procedure and commands the provision of an extremely large facility in order to accommodate all of the equipment needed to perform each of these steps.

The disadvantages associated with the above-discussed conventional method are compounded even further where a plating film having a plurality of regions each containing a different composition (e.g., a different concentration of insoluble particles or metallic components or mixtures of plating solution) is prepared. For example, it is sometimes desirable to prepare a plating layer having a first region proximal to the outer surface of the film with a certain composition, and a second region proximal to the opposing surface contacting the base material with a different composition. In this case, a plurality of separate plating solutions, with each plating solution having a different composition from the others, is needed to prepare the different regions of plating layer. Similarly, where several types of products are prepared, and each of the product types contains a plating film having a specific metal composition that differs from the metal compositions of the other product types, the provision of a different plating solution for each product type is required. The provision of a plurality of plating baths to obtain the above-discussed variations of plating films in accordance with conventional techniques further complicates the plating procedure and still further increases the cost for and space needed in the production facility.

In the above-discussed conventional electroplating methods, after pretreatment is completed the aluminum base material is immersed in a plating solution, and a voltage is applied between electrodes. This forms an electroplating film 52 on the surface of a base material 51 as shown in FIG. 14.

As further illustrated by the arrows in FIG. 14, the plating film 52 electroplated on the base material 51 develops an internal residual stress in the shrinking or compressive direction. The residual stress is believed to be attributable to the absorption of hydrogen atoms by metal ions in the plating solution when the plating film 52 is being formed. The absorbed hydrogen atoms generate hydrogen gas, which is expelled as the plating film 52 is being deposited. The expulsion of the hydrogen gas provides the plating film 52 with a microscopically porous structure, thereby generating a compressive force toward the center portion of the plating film 52. The residual stress in the shrinking direction is thus generated. The residual stress in the plating film 52 can lead to the formation of cracks in the plating film 52 or cause the film 52 to delaminate from the base material 51.

If the material 51 has a narrow groove 53 as shown in FIG. 15 or a recess, it is difficult to introduce the plating solution into the groove 53, and especially difficult to contact the solution to the bottom of the groove 53, by practicing the conventional immersion technique. Consequently, the groove 53 often is not covered with the electroplating film 52 when coated in accordance with conventional processes. Accordingly, the prior art method often fails to produce the desired plated products.

A need therefore exists to provide a process for making a composite structure comprising a substrate formed from a metal base material and a plating film electroplated on the metal base material, in which the composite structure can be produced in a more efficient and cost effective manner, and in which the resulting composite structure is not prone to cracking or delamination and has the plating film formed in narrow grooves and recesses.

SUMMARY OF THE INVENTION

It is, therefore, an object of the present invention to solve the aforementioned problems associated with the related art as well as the need expressed above.

Specifically, it is a primary objective of the present invention to provide a plating method that has a reduced number of steps and a simplified plating process in comparison to the aforementioned conventional plating process, such that the amount of equipment and size of facility needed to accommodate the equipment is reduced. It is also part of the primary objective that the reduction in process equipment and facility requirements be realized when preparing an alloy plating film from a metal plating solution containing at least two kinds of metal ions.

Another objective of the present invention is to provide a plating method that prevents cracks and delamination of the plating film after the layer is formed on a substrate prepared from a metallic base material.

Yet another objective of the present invention is to provide a plating method for forming a plating film on a metal material having a groove or recess so that the inner walls of the groove or recess are coated with the plating film.

In accordance with the principles of the present invention, the foregoing and other objectives are obtained by providing a method of making a composite structure comprising a plating film on a substrate having at least a surface portion formed from a metal base material. According to this method, a composite plating solution comprising a plating solution and insoluble particles are discharged from a one or more conductive discharging devices and impacted on the surface portion of the substrate at a predetermined flow rate. The discharging and impacting steps are initially controlled so as to abrade the surface of the metal base material with the insoluble particles in the plating solution discharged from the discharging device. During or subsequent to the abrading step, a voltage is applied between the base material and the discharging device, which are electrically connected by the composite plating solution, in order to deposit the plating film on the surface portion of the substrate.

The principles of the present invention enunciated above are applicable to all types of composite structures, but have particular applicability to car bumpers, rear-view mirrors, reflectors, electric and electronic parts, precision machine parts, air plane parts, engine pistons, bus-bars and electrical cables.

These and other objects, features, and advantages of the present invention will become apparent from the following detailed description when taken in conjunction with the accompanying drawings which illustrate, by way of example, the principles of the present invention.

BRIEF DESCRIPTION OF THE DRAWINGS

In order that the manner in which the above-recited and other advantages and objects of the invention are obtained may be better understood, a more particular description of the invention described above will be rendered by reference to the appended drawings. Understanding that these drawings only provide information concerning typical embodiments of the invention and are not therefore to be considered limiting of its scope, the invention will be described and explained with additional specificity and detail through the use of the accompanying drawings in which.

DETAILED DESCRIPTION OF THE PREFERRED EMBODIMENTS

A first embodiment of the present invention will now be described with reference to FIGS. 1 to 4.

Figure 2:
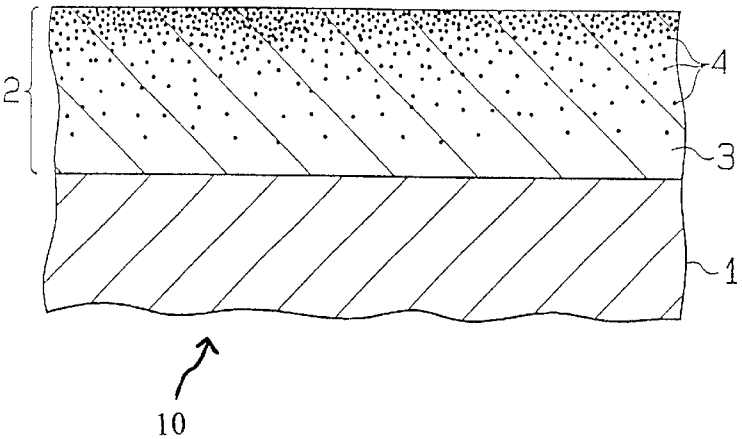
FIG. 2 is a schematic cross-sectional view of a composite structure containing a substrate formed from a metallic base material and a plating film disposed thereon, the composite structure being prepared in accordance with a first embodiment of the present invention.

FIG. 2 is a schematic cross-sectional view illustrating a composite structure, generally designated by reference numeral 10, comprising a plating film 2 formed on a substrate 1 formed from at least an aluminum base material. The film 2 contains nickel as a metal matrix 3 and silicon carbide as insoluble particles 4 co-deposited with, or dispersed in, the matrix 3. The thickness of the plating film 2 is, for example, about 50 $\mu$m. The insoluble particles 4 have, on average, a maximum particle diameter of, for example, about 1.7 $\mu$m. (Insoluble particles having, on average, a maximum particle size of about 500 $\mu$m are mixed in the particles 4 for a blasting or abrading treatment on the surface of the substrate 1).

Preferably, the amount of insoluble particles 4 deposited on the base material is controlled so that the concentration of insoluble particles 4 in the film 2 continuously and gradually changes from the inner surface interfacing the surface portion of the substrate 1 to the outer surface of the film 2. According to this preferred embodiment, the concentration of insoluble particles 4 in the metal matrix 3 increases in a direction from the inner surface interfacing the substrate 1 to the outer surface, such that the insoluble particles 4 account for about zero percent volume at the inner surface interfacing the substrate 1, and about 30% volume at the outer surface. In short, the plating film 2 according to this embodiment has a nonuniform concentration of the insoluble particles 4 that varies across the thickness of the plating film 2.

Next, a plating apparatus for forming the above-described plating film 2 will be described.

Figure 1:
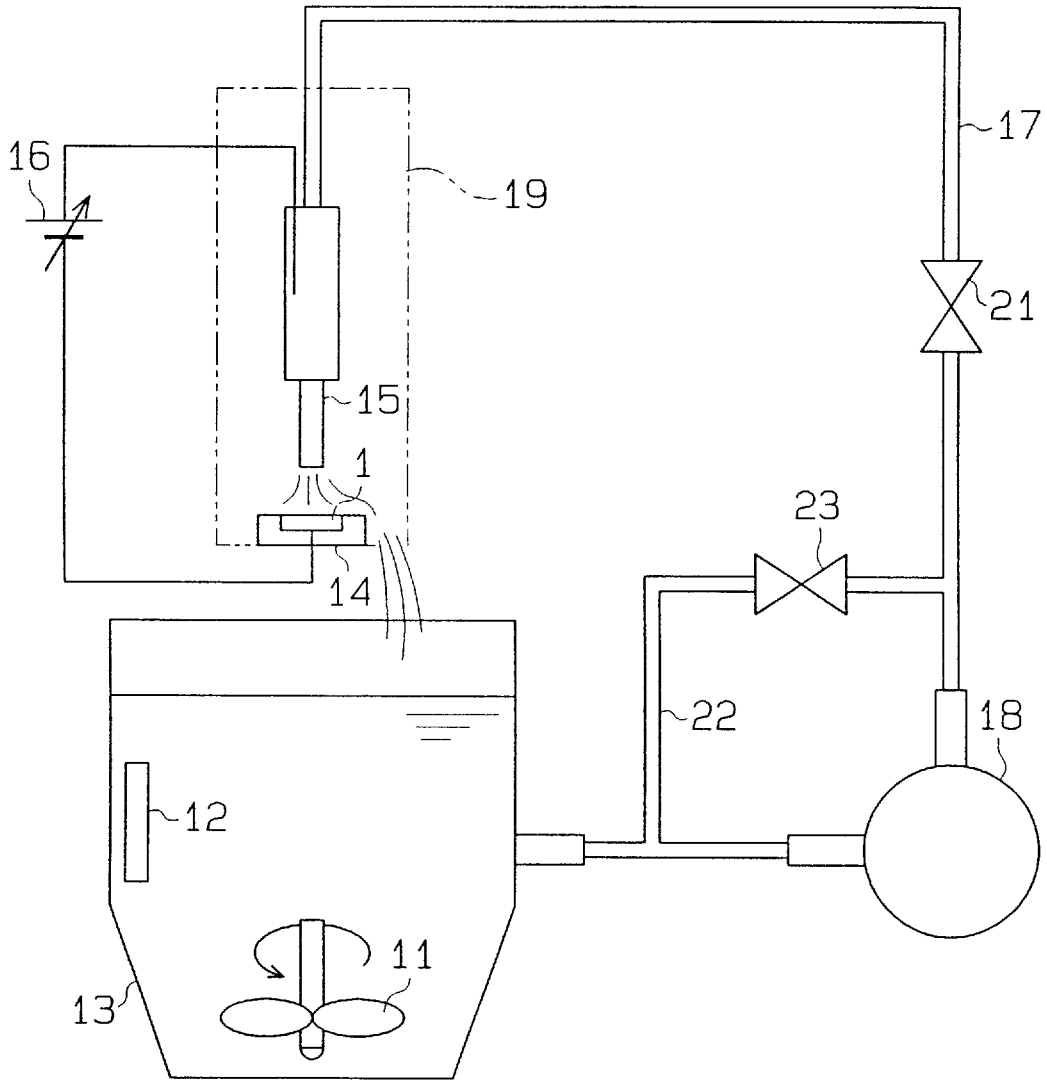
FIG. 1 is a schematic diagram showing a plating apparatus suitable for carrying out the process of the present invention.

As shown in FIG. 1, the plating apparatus according to this embodiment includes a tank 13 having a stirrer 11 and a heater 12 located therein. The tank contains a composite plating solution of a composition to be described below. A table 14 is provided for receiving the base material 1. The table 14 is located above the tank 13, and a nozzle 15 is located above the table 14. The nozzle 15 is connected to an anode of a power supply 16, while the table 14 is connected to a cathode of the power supply 16.

A communication passage 17 connects the tank 13 with the nozzle 15. The communication passage 17 includes a pump 18. When operating, the pump 18 pumps the composite plating solution from the tank 13, in which the solution is heated and stirred homogeneously, through the communication passage 17 and to the nozzle 15. The nozzle 15 discharges (e.g., sprays) the composite plating solution therefrom so that the solution is introduced onto the surface of the base material 1 on the table 14. The table 14 and the nozzle 15 are housed in a box-like jet cell 19 so that the discharged composite plating solution does not splatter into other components of the apparatus.

A main valve 21 is located in the communication passage 17 on the downstream side of the pump 18. The amount of the composite plating solution discharged from the nozzle 15 is controlled by partially or completely opening and closing the valve 21. A bypass passage 22, which bypasses the pump 18, provides an alternative flow path. The entrance of the bypass passage 22 is located upstream from the side of the pump 18 in the communication passage 17, and the exit of the bypass passage 22 is located downstream of the pump 18 along the communication passage 17. A sub-valve 23 is located in the bypass passage 22. The flow rate of the composite plating solution passing through the bypass passage 22 and being discharged from the nozzle 15 is controlled by partially or completely opening and closing the valves 21 and 23.

The metal plating solution in this embodiment can be selected from any type of plating solution containing one or more metal ions. The plating solution can be, for example and without limitation, a nickel plating solution, a copper plating solution, a zinc plating solution, a tin plating solution, or a combination of any of the above-listed plating solutions.

The insoluble particles 4 of this embodiment, which are dispersed in the metal plating solution to form the composite plating solution, can include one or more of the following: an oxide, such as alumina, zirconia, silica, titania, ceria, or a combination of two or more of these oxides; one or more carbides, such as silicon carbide and titanium carbide; one or more nitrides, such as silicon nitride and boron nitride; one or more organic polymer powders, such as fluororesin powder, polyamide powder and polyethylene powder; or any combination thereof. However, the insoluble particles 4 of this embodiment alternatively can be any material other than the above-listed materials, so long as the material is insoluble with and dispersible in the selected metal plating solution and hard enough to remove an oxide film formed on a metallic base material when abraded against the metallic base material in accordance with an embodiment of the process of the present invention.

The maximum insoluble particle size is, on average, preferably in a range of from about 0.1 $\mu$m to about 1000 $\mu$m.

The concentration of the insoluble particles dispersed in the metal plating solution is preferably in a range of from about 1 g/l to about 1000 g/l, and more preferably in a range of from about 10 g/l to about 500 g/l. Of course, the concentration of insoluble particles can be varied across the thickness of the resulting plating film 2.

The current velocity of the discharged composite plating solution is preferably not less than 4 m/s, more preferably about 6 m/s, still more preferably about 10 m/s, and most preferably about 12 m/s. However, the current velocity should be slow enough not to deform the metal base material. As referred to herein, deformation of the metal base material does not include abrading of the outer surface portion of the base material.

The composite plating solution of this embodiment includes metal plating solution and the insoluble particles 4. A suitable composition for the metal plating solution is, for example, $NiSO_4$ (300 g/l), $NiCl_2$ (60 g/l) and $H_3BO_3$ (40 g/l), and the concentration of the insoluble particles 4 contained (dispersed) in the solution is about 50 g/l at room temperature.

The plating conditions are preferably selected so that the temperature of the composite plating solution is maintained at about 55° C. by the heater 12, and the pH and the current density are about 4.5 and about $40\times10^2$ A/m$^2$, respectively, and the plating solution contact time is about 480 seconds.

Next, a plating method for forming the plating film 2 using the above-described plating apparatus will be described.

The substrate 1 is placed in the table 14. Then the power supply 16 is activated for operating the pump 18. It should be noted here that the sub-valve 23 is totally closed and the main valve 21 is fully open at the initial stage of operation. The pump 18 drives the composite plating solution through the communication passage 17 until the solution is discharged from the nozzle 15 and is in turn received by the surface of the substrate 1 for a set contact time. The flow rate of the discharged composite plating solution is, for example, about 12 m/s. Discharging the solution at such a high flow rate allows the insoluble particles 4 in the solution, which optionally during at least the initial stage of the discharging step are primarily large particles having, on average, a maximum particle size of, for example, about 500 $\mu$m, to remove the oxide film from the surface portion of the substrate 1.

Also, discharging the plating solution from the nozzle 15 electrically connects the nozzle 15 and the substrate 1. The nozzle 15 serves as an anode and the metallic base material 1 serves as a cathode. Applying voltage between the nozzle 15 and the metallic base material 1 allows the metal ions in the solution to be deposited as the metal matrix 3. The deposited matrix 3 forms the plating film 2.

Since the plating solution is discharged at a high flow rate as described above, the insoluble particles 4 are not adsorbed on the surface portion of the substrate 1; rather, the insoluble particles are displaced from the surface of the substrate 1 so that substantially no insoluble particles 4 are retained in the metal matrix 3. Accordingly, the metal matrix 3 possesses a relatively high purity in a region adjacent to the metallic base material 1.

The flow rate of the composite plating solution discharged from the nozzle 15 is thereafter gradually reduced by closing the main valve 21 or opening the sub-valve 23. This decreases the flow rate of the plating solution received by the surface portion of the substrate 1. By continuously decreasing the flow rate of the discharged plating solution, the concentration of insoluble particles 4 in the resulting film 2 is increased from the inner surface of the plating film 2 to the outer surface during formation of the film 2.

The functions and effects of the process according to the first embodiment of the present invention will now be described.

According to the first embodiment, the plating solution initially contacts the surface portion of the substrate 1 at a relatively high flow rate. This removes the oxide film on the aluminum base material 1 and forms the plating film 2. Moreover, the resulting plating film 2 has a high adherence to the metallic base material 1. This results in a significantly reduced number of steps, simplifies the procedure and equipment, and significantly reduces the costs for forming plating films in comparison to the conventional method discussed above in the Background section. The adherence of the plating film 2 according to the first embodiment is about as effective as that of the conventional method since the plating film 2 is formed on the base material 1 after the oxide film is removed.

In the first embodiment, the flow rate of the discharged plating solution is controlled, which permits the co-deposited amount of the insoluble particles 4 in the metal matrix 3 to be controlled through the thickness of the plating film 2. The plating solution is discharged from the nozzle 15 and the flow rate thereof is gradually reduced as the plating film 2 builds in thickness on the surface portion of the substrate 1. Therefore, the co-deposited amount of insoluble particles 4 in the resulting film 2 is increased from an inner surface interfacing the metallic base material 1 to the outer surface. This results in the plating film 2 having a high adhesive property with respect to the base material 1, and the outer surface of the plating film 2 having an improved abrasion resistance.

In the first embodiment, the insoluble particles 4 of various particle sizes are mixed in the metal plating solution. The greater kinetic energy of the larger particles 4 readily removes the oxide film on the metallic base material 1. The smaller particles 4 are readily co-deposited and dispersed in the metal matrix 3. This ensures the above-described effects.

Described below are the procedures and results of experiments that were carried out in order to confirm the above effect.

Figure 3:
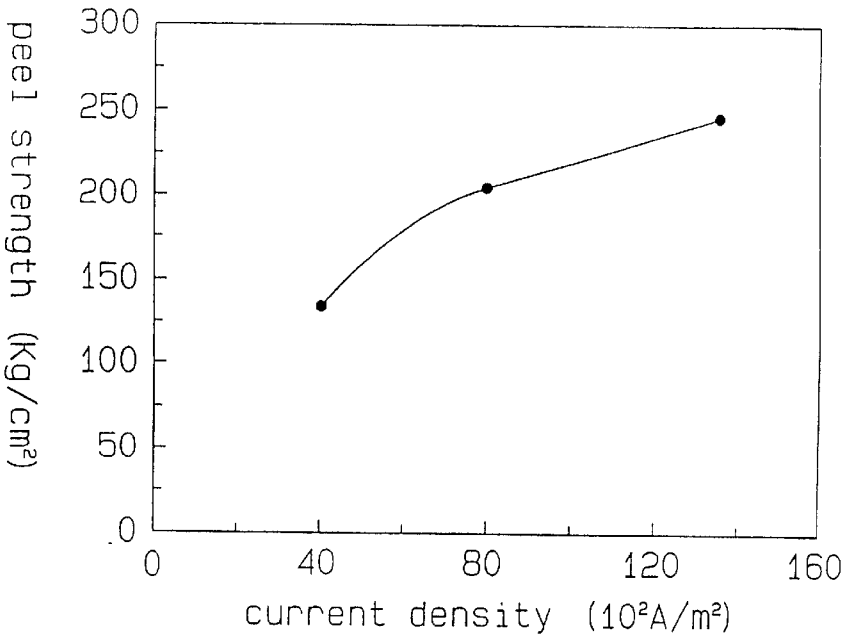
FIG. 3 is a graph showing the relationship between current density and peel strength for the composite structure prepared in accordance with the first embodiment of the present invention.

In the first experiments, the current density (i.e., the density of insoluble particles in the composite plating solution) was varied to obtain plating films 2 of different peel strengths. The flow rate of the composite plating solution was maintained at 8 m/s and the quantity of electricity was 55° C. The current densities in the first experiments were $40\times10^2$ A/m$^2$, $80\times10^2$ A/m$^2$ and $135\times10^2$ A/m$^2$. The composite plating solution comprised a plating solution of water containing silicon carbide insoluble particles having, on average, maximum particle sizes of 1.7 $\mu$m. The test results are shown in FIG. 3. The peel strength measurement was carried out according to Japanese Industrial Standard (JIS) 8504.

As shown in FIG. 3, the plating films prepared in accordance with this first embodiment have peel strengths that are almost as effective as that obtained by the conventional process (zinc immersion process: 300 kgf/cm$^2$). As illustrated by FIG. 3, when the flow rate of the composite plating solution is maintained constant, the peel strength of the plating film 2 is improved by providing the composite plating solution with a high current density.

In the second experiments performed in accordance with the first embodiment of the present invention, the flow rate of the composite plating solution and the particle size of the insoluble particles 4 were varied. Other plating conditions were substantially the same as described above in the first experiment. The metal plating solution included $NiSO_4$ (300 g/l), $NiCl_2$ (60 g/l), $H_3BO_3$ (40 g/l). The concentration of the insoluble particles 4 dispersed in the composite plating solution was 50 g/l. Experiments were conducted for composite plating solutions containing insoluble particles having particle sizes of 2.8 $\mu$m, 1.7 $\mu$m, and 0.6 $\mu$m. The plating conditions were preset such that the temperature of the plating solution was maintained at 55° C. by the heater 12, the pH and current density were 4.5 and $40\times10^2$ A/m$_2$, respectively, and the composite plating solution contact time against the substrate 1 was 480 seconds. The test results are shown in FIG. 4.

Figure 4:
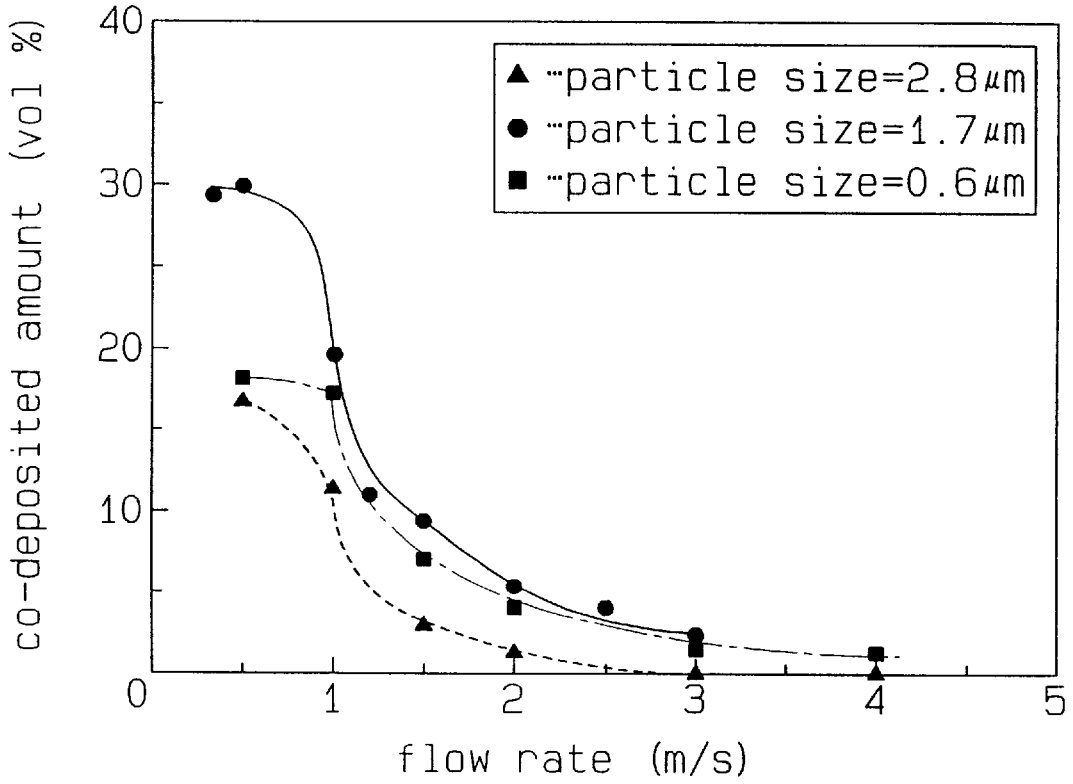
FIG. 4 is a graph showing co-deposited amount as a function of the flow rate and particle size of insoluble particles for the composite structure prepared in accordance with the first embodiment of the present invention.
Figure 8:
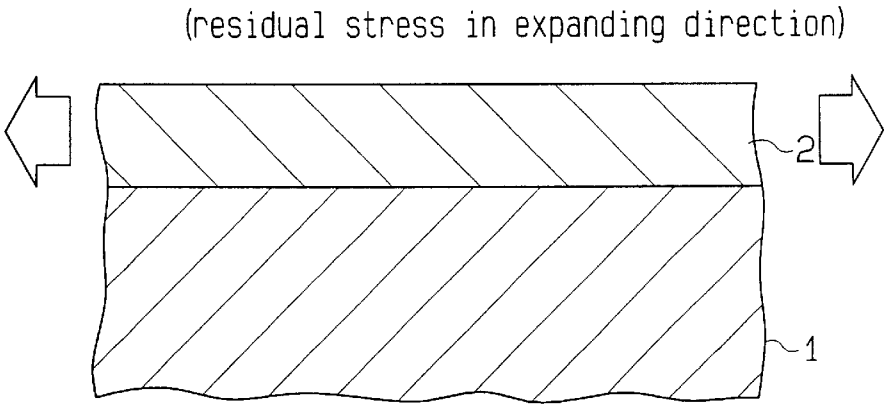
FIG. 8 is a schematic cross-sectional view for explaining residual stress in the plating films of the respective composite structures prepared in accordance with the third and fourth embodiments of the present invention.

As shown in FIG. 4, the amount of insoluble particles 4 deposited and accumulated on the surface portion of the substrate 1 varies as function of flow rate for each of the particle sizes of the particles 4 dispersed in the plating solution. For example, 20 to 30 vol % of the insoluble particles 4 are co-deposited at a flow rate of slightly more than 0 m/s, and the co-deposited amount of the particles 4 decreases as the flow rate increases. At the flow rate of about 3 m/s to about 4 m/s, the co-deposited insoluble particles 4 amounts to slightly more than about 0 vol % for each solution. These test results show that the amount of co-deposition of insoluble particles can be controlled readily and effectively by suitably adjusting the flow rate of the composite plating solution discharged from the nozzle 15 to the surface portion of the substrate 1.

A process according to the second embodiment of the present invention will now be described with reference to FIGS. 1, 5, 6 and 7. Since the principles of this second embodiment are substantially the same as those of the first embodiment, only the difference will be described below.

Figure 5:
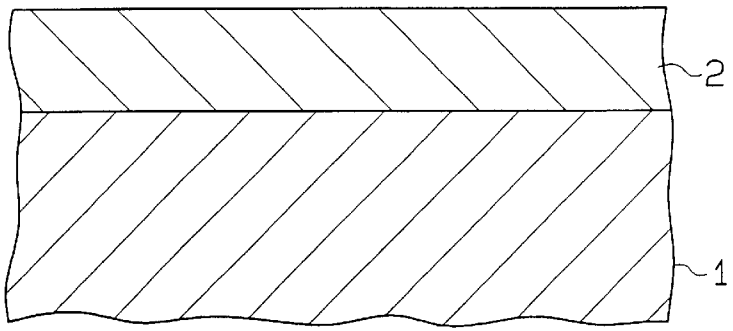
FIG. 5 is a schematic cross-sectional view of a composite structure containing a substrate formed from a metallic base material and a plating film, the composite structure being prepared in accordance with second to fourth embodiments of the present invention.

FIG. 5 is a schematic cross-sectional view illustrating a plating film 2 formed on a substrate 1 formed from an aluminum base material. The plating film 2 includes nickel and phosphorus. In this embodiment, the concentration of phosphorus is the highest at the outer surface (the top surface portion in FIG. 5) and decreases towards the metallic base material. In other words, the concentration of nickel is the highest at the region adjacent to the substrate 1 and decreases toward the outer surface of the plating film 2.

The plating film 2 according to the second embodiment is formed by the plating apparatus described in the first embodiment.

The metal plating solution according to the second embodiment comprises a plating solution containing two or more kinds of ions. The ions can be, for example and without limitation, (A) a combination of metal and metalloid (for example and without limitation, nickel+phosphorus, nickel+boron, or nickel+phosphorus+boron) or (B) a combination of metal and metal (for example and without limitation, nickel+copper, nickel+iron, or gold+vanadium+copper).

When utilizing the combination of metal and metalloid, the metal components are deposited by electrodeposition, while the metalloid components are not deposited by electrodeposition. The deposited amount in metal-metalloid combinations changes in accordance with changes in flow rate. This is explained as follows. As the metal is electrically deposited on the metallic base material, the metalloid components are intermixed with and covered by the metal component. It is presumed that the alloy plating film including both the metal and metalloid elements is formed in the above manner. In the metal combinations (B), metal ions are deposited by electrodeposition. Therefore, increasing the flow rate increases the deposition amount of metal that has a high deposition potential.

The plating solution according to this second embodiment can include, for example and without limitation, sulfamic acid nickel [$Ni(NH_2SO_4)\cdot 4H_2O$] (430 kg/m$^3$), nickel chloride [$NiCl_2\cdot 6H_20$] (15 kg/m$^3$) boric acid [$H_3BO_3$] (45 kg/m$^3$), and saccharin [$C_7H_6NO_3S$] (5 kg/m$^3$). The solution further can include hypophosphorous acid [$H_3PO_2$] (0.5 kg/m$^3$).

The plating conditions of this embodiment are preferably selected so that the temperature of the plating solution is maintained at 328K by the heater 12, the pH and current density are about 2.0 and about $80\times10^2$ A/m$^2$, respectively, and the plating solution contact time is about 480 seconds. It should be noted that these selected conditions are merely examples, and should not be construed as limiting the scope of the present invention or this embodiment.

Next, a plating method for forming a plating film 2 using the above-described plating apparatus and plating conditions will be described.

The substrate 1 having at least a surface portion formed from a metallic base material is placed on the table 14. Then the power supply 16 is activated for operating the pump 18. The opening of the sub-valve 23 and the main valve 21 is properly adjusted to permit the pump 18 to pump the plating solution through the communication passage 17 until the solution is discharged from the nozzle 15 and is in turn received by the surface portion of the substrate 1. The flow rate of the discharged plating solution is maintained relatively high, for example 1 m/s or higher.

Discharging the plating solution from the nozzle 15 electrically connects the nozzle 15 and the metallic base material 1. The nozzle 15 serves as an anode and the metallic base material 1 serves as a cathode. Applying voltage between the nozzle 15 and the base material 1 allows the metal ion (nickel and phosphorus) in the metal plating solution to be co-deposited as the metal matrix. The deposited matrix contributes to the formation of the plating film 2.

The flow rate of the discharged plating solution is preferably controlled. For example, the flow rate is 1 m/s at the initial stage of operation. The flow rate is gradually increased up to 6 m/s. When the flow rate is relatively low, the amount of phosphorus supplied to the deposited nickel is relatively small. Accordingly, the amount of phosphorus absorbed by the deposited nickel is small. Therefore, a lower flow rate of the discharged solution results in a lower concentration of phosphorus in the alloy plating film 2. On the other hand, when the flow rate is relatively high, the amount of phosphorus supplied to the deposited nickel is relatively great. Accordingly, contrary to the above case, a greater amount of phosphorus is absorbed by the deposited nickel. Therefore, a higher flow rate of the discharged solution results in a higher concentration of phosphorus in the alloy plating film 2. As described above, the alloy composition of the alloy plating film 2 is preferably controlled by adjusting the flow rate of the discharged plating solution.

The functions and effects of the second embodiment will now be described.

According to the second embodiment, the composition of alloy plating film 2 is readily controlled by properly adjusting the flow rate of discharged plating solution. That is, the second embodiment of the present invention, unlike the conventional method requiring different types of plating solutions, changes the composition of the alloy plating film 2 by utilizing only one type of plating solution. This greatly simplifies the plating procedure and reduces the costs associated with the plating procedure by requiring only one plating bath.

According to the second embodiment, the metal composition is varied, according to the depth of the plating film 2, by changing the flow rate of the discharged plating solution. This gradually varies the alloy composition of a single plating film 2 as a function of film thickness without forming a plurality of layers. Therefore, no delamination occurs in the plating film 2.

According to the second embodiment, the flow rate of the plating solution is relatively slow at the initial stage of the plating, and is gradually increased. This increases the concentration of nickel in the region adjacent to the base material 1 by changing the concentration of insoluble particles in the region. Nickel is more adsorbable by the aluminum base material 1 than phosphorus. Therefore, the higher nickel concentration improves the adhesion between the base material 1 and the plating film 2. The concentration of phosphorus is increased toward the outer surface of the film by gradually increasing the flow rate of the discharged plating solution. This increases the hardness of the outer surface of the film (since higher concentration of phosphorus increases the hardness of the material). As described above, the second embodiment controls the composition of the alloy plating film 2 to satisfy various purposes and required characteristics.

Figure 7:
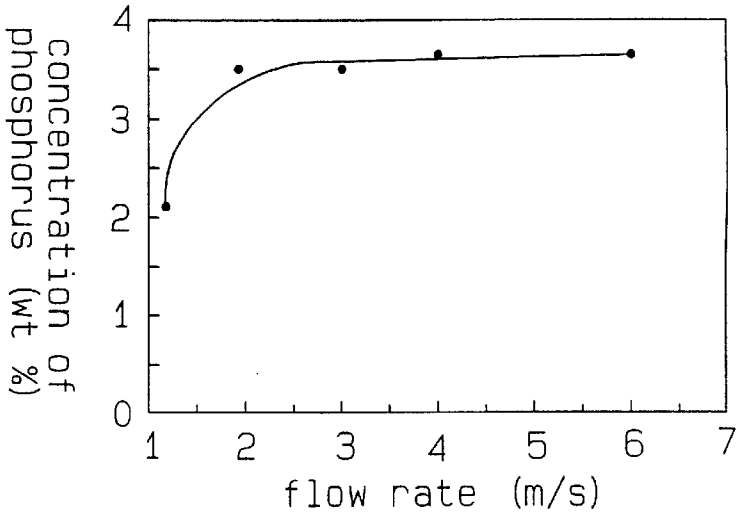
FIG. 7 is a graph showing the relationship between flow rate and concentration of phosphorus in the plating film of the composite structure prepared in accordance with the second embodiment of the present invention.
Figure 6:
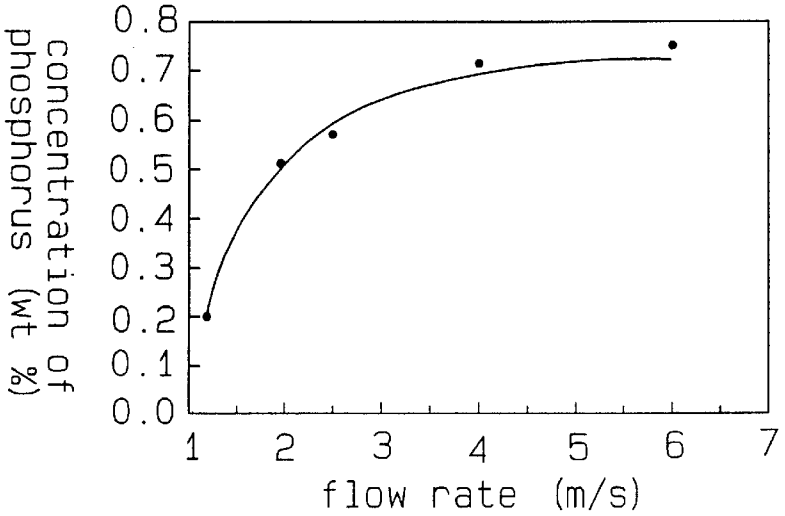
FIG. 6 is a graph showing the relationship between flow rate and concentration of phosphorus in the plating film of the composite structure prepared in accordance with the second embodiment of the present invention.

Described below are the procedures and results of experiments that were carried out in order to confirm the above effect. In the experiments, the above described aluminum base material 1 and plating solution were used. The flow rate of the discharged plating solution was varied. The concentration of phosphorus in the resulting alloy plating film 2 was measured. The thickness of the alloy plating film 2 was 60 $\mu$m. The test results are shown in FIGS. 6 and 7. FIGS. 6 and 7 show the cases where the concentration of hypophosphorous acid ($H_3PO_2$) in the plating solution was 0.5 kg/m$^3$ and 5.0 kg/m$^3$ respectively.

As shown in FIGS. 6 and 7, the concentration of phosphorus in the plating film 2 increases as the flow rate increases. The figures also show that lower flow rates result in lower concentration of phosphorus in the film 2. Thus, since the concentration of phosphorus is being decreased at lower flow rates, the overall concentration of nickel is consequently being increased in the lower flow rate regions. The test results show that the plating method according to the second embodiment of the present invention readily controls the composition of the alloy plating film 2. An alloy plating film 2 having a desired composition is obtained, accordingly.

A third embodiment of the present invention will now be described with reference to FIGS. 1, 8, 9 and 10. Since the principles of this third embodiment are similar to those of the first and second embodiments, only the difference will be described below.

FIG. 5 is a schematic cross-sectional view illustrating a plating film 2 formed on a substrate 1 having at least a surface portion formed from an aluminum base material. The plating film 2 includes an insoluble particle. The plating film 2 according to the third embodiment is formed by the plating apparatus described in the first embodiment.

The metal plating solution according to the third embodiment can comprise a plating solution containing one or more metal ions. The metal plating solution can be, for example and without limitation, a nickel plating solution, a copper plating solution, a zinc plating solution, a stannum (i.e., tin) plating solution, or any combination of the above-listed plating solutions.

The insoluble particles of this embodiment, which are dispersed in the metal plating solution to form a composite plating solution, can include one or more of the following: an oxide, such as alumina, zirconia, silica, titania, ceria, or a combination of two or more of the about-listed oxides; one or more carbides, such as silicon carbide and titanium carbide; one or more nitrides, such as silicon nitride and boron nitride; one or more organic polymer powders, such as fluororesin powder, polyamide powder and polyethylene powder; or any combination thereof. However, the insoluble particles 4 of this embodiment alternatively can be any material other than the above-listed materials, so long as the material is insoluble with and dispersible in the metal plating solution at room temperature and hard enough to remove an oxide film formed on a metal base material when abraded on the metal base material in accordance with an embodiment of the process of the present invention.

The average insoluble particle size is preferably in a range of from about 0.1 $\mu$m to about 1000 $\mu$m.

The concentration of the insoluble particles dispersed in the metal plating solution can be, by way of example and without limitation, preferably in a range of from about 1 g/l to about 1000 g/l, and more preferably in a range of from about 10 g/l to about 500 g/l.

According to the present invention, the composite plating solution is applied to the surface of a base material at a certain flow rate. This is in contrast to the conventional method discussed in the Background section above, in which a base material is immersed in plating solution. The plating solution is discharged from the nozzle 15. At the initial stage of the plating operation, the flow rate of the discharged plating solution should be high enough so that hydrogen atoms are not absorbed in the plating film that is being formed on the metal base material.

The plating solution according to this embodiment can include, by way of example and without limitation, a solution of sulfamic acid nickel [$Ni(NH_2SO_4)\cdot 4H_20$] (430 kg/m$^3$), nickel chloride [$NiCl_2\cdot 6H_20$] (15 kg/m$^3$), boric acid [$H_3BO_3$] (45 kg/M$^3$), and saccharin [$C_7H_5NO_3S$] (5 kg/m$^3$). The plating conditions of this embodiment are preferably selected so that the temperature of the plating solution is maintained at 328K by the heater 12, the pH and current density are about 2.0 and about $40\times10^2$ A/m$^2$, respectively, and the plating solution contact time is about 480 seconds. It should be noted that these selected conditions are merely examples, and are not limiting on the scope of the present invention or this embodiment.

Next, a plating method for forming the plating film 2 using the above-described plating apparatus will be described.

The substrate 1 is placed on the table 14. Then the power supply 16 is actuated for operating the pump 18. The opening of the sub-valve 23 and the main valve 21 is properly adjusted. This allows the pump 18 to pump the composite plating solution through the communication passage 17 until the solution is discharged from the nozzle 15 and in turn is received by the surface portion of the substrate 1. The flow rate of the discharged plating solution is maintained relatively high.

Discharging the plating solution from the nozzle 15 electrically connects the nozzle 15 and the metallic base material 1. The nozzle 15 serves as an anode and the metallic base material of the substrate 1 serves as a cathode. Applying voltage between the nozzle 15 and the metallic base material 1 allows the metal ions (nickel) in the metal plating solution to be deposited as the metal matrix. The deposited matrix forms the plating film 2. The plating film 2 is formed by the pressurized plating solution discharged from the nozzle 15. Accordingly, the resulting plating film 2 has residual stress in the horizontal direction depicted by the arrows in FIG. 8, or the expanding direction.

The functions and effects of the third embodiment of the present invention will now be described.

According to the third embodiment, the strong plating film 2 is formed on the surface portion of the substrate 1 by impacting the metal plating solution to at least the metallic base material of the substrate 1 at a certain flow rate, rather than immersing the outer surface of the metallic base material 1 in the plating solution. Especially in this embodiment, the flow rate of the discharged plating solution is high enough to prevent hydrogen atoms from being absorbed in the plating film 2. As explained above in connection with the conventional method, if absorbed in the film, hydrogen atoms are discharged as hydrogen gas from the resulting plating film, thereby making the film microscopically porous. The third embodiment prevents the resulting film 2 from being porous by forming the plating film 2 with a highly pressurized plating solution discharged from the nozzle 15. This results in a residual stress acting as an expanding force as shown by the arrows in FIG. 8. The residual stress in the direction illustrated in FIG. 8 enforces the adhesion at the interface of the plating film and the base material 1 and restricts the occurrences of cracks in the plating film 2.

In the third embodiment, the flow rate of the plating solution can be at least 4 m/sin order to ensure the above-described effects.

The conventional plating method immerses a base material in plating solution for obtaining a plating film. Unlike the conventional method, the third embodiment of the present invention forms a plating film by discharging plating solution from a nozzle and applying it to a base material. The process of the present invention thereby eliminates the necessity for a large container in which the entire base material is immersed in plating solution; consequently, a reduction in requisite facility space and production costs is realized.

According to the third embodiment, the metallic base material 1 is made of aluminum. Therefore, the base material 1 is prone to be plastically deformed (that is, capable of being deformed without rupture or relaxation) by a relatively high flow rate of the discharged solution. Application of a suitable flow rate of discharged solution causes the resulting plating film 2 to have residual stress in the expanding direction, which enhances the adhesion of the plating film to the base material 1 and effectively prevents cracks in the resulting plating film 2. Moreover, oxide films that are usually prone to be formed on the aluminum base material 1 are removed by the discharged solution without requiring independent and additional steps designed for that purpose. The number of steps in the plating method according to this embodiment is, therefore, reduced in comparison to the conventional process.

Described below are the procedures and results of experiments that were carried out in order to confirm that the above-described plating film 2 has a residual stress in the expanding direction.

The above-described aluminum base material, a plating solution having the above-described composition, and the above described plating apparatus were used in the following experiment. The flow rate of discharged plating solution was varied. The residual stresses of plating films formed under the different flow rates were measured by a side inclination method using a micro X-ray residual stress measuring apparatus. The thicknesses of each of the plating films were 60 $\mu$m. The test results are shown in FIG. 9.

Figure 9:
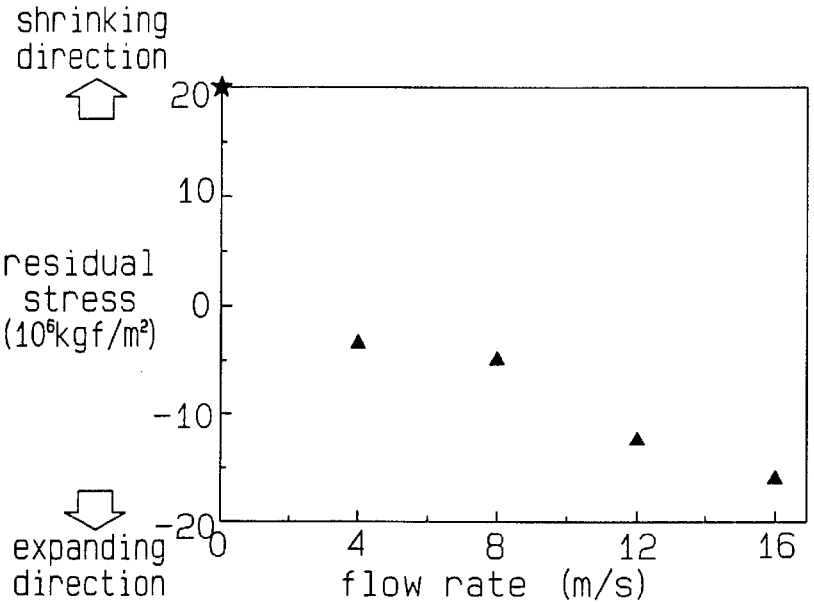
FIG. 9 is a graph showing the relationship between flow rate and residual stress in the plating film of the composite structure prepared in accordance with the third embodiment of the present invention.
Figure 14:
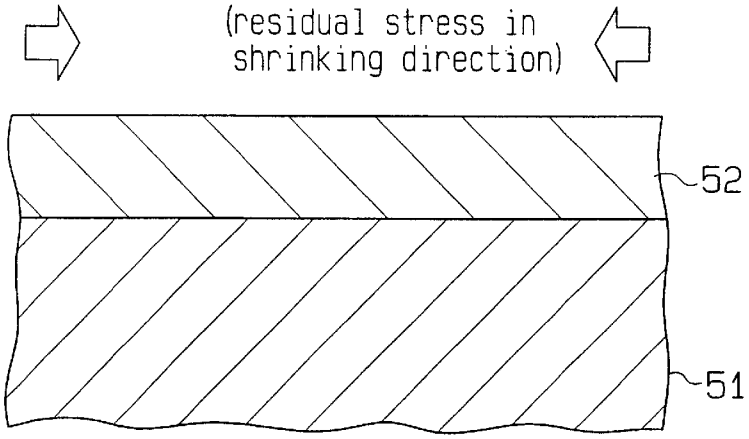
Fig.14 (Prior Art)
FIG. 14 is a schematic cross-sectional view for explaining the remaining stress in a plating film prepared in accordance with a conventional plating process.

FIG. 9 shows that the residual stress in the expanding direction increases as the flow rate increases. Contrarily, when the flow rate is zero (that is, when the known immersing plating method is utilized), the residual stress is high in the horizontally shrinking direction (see FIG. 14). The test results show that the third embodiment allows the plating film to have a residual stress in the expanding direction. The residual stress in the expanding direction restricts the occurrence of cracks in the resulting plating film.

A fourth embodiment of the present invention will now be described with reference to FIGS. 1, 8, 9 and 10. Since the principles of this embodiment are substantially the same as the third embodiment, only the difference will be described below.

In the fourth embodiment, the plating solution with silicon carbide (SiC) insoluble particles having, on average, a particle size of 300 $\mu$m mixed therein can be employed. The concentration of the insoluble particles in the plating solution can be, for example, about 10 g/l.

The functions and effects of the fourth embodiment of the present invention will now be described. The same plating apparatus as employed in the first embodiment is utilized for forming the plating film 2 of the fourth embodiment.

According to the fourth embodiment, a strong plating film 2 is formed on at least the metallic base material portion of the substrate 1 by applying the metal plating solution to the substrate 1 at a certain flow rate. Since the metal plating solution according to the fourth embodiment contains insoluble particles dispersed therein to form a composite plating solution, discharging the metal plating solution from the nozzle 15 causes the insoluble particles to impact continuously on and apply stress to the surface of the metallic base material. The applied stress is converted into residual stress in the expanding direction on the base material 1. Accordingly, the resulting plating film 2 formed on the base material 1 has a residual stress in the expanding direction across the entire thickness of the film 2. This ensures the beneficial effects described above in connection with the third embodiment of the present invention.

Described below are the procedures and results of experiments that were carried out in order to confirm that the resulting plating film 2 has a residual stress in the expanding direction. For each experiment, the above-described aluminum base material, the plating solutions having the above-described compositions, and the above-described plating apparatus were used. In each experiment, the flow rate of the discharged plating solution was varied, the thickness of the plating film was 60 $\mu$m, and the residual stress of plating films formed under the different flow rates were measured by a side inclination method using a micro X-ray residual stress measuring apparatus. The test results are shown in FIG. 10.

Figure 10:
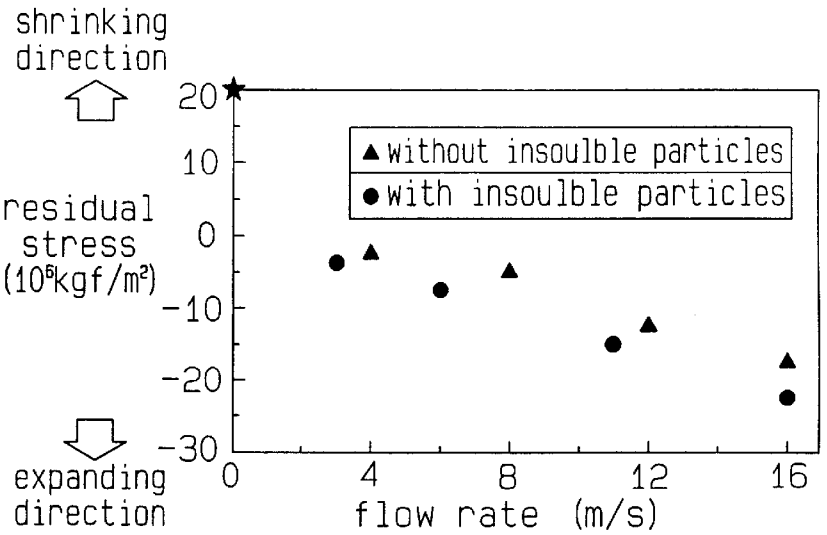
FIG. 10 is a graph showing the relationship between flow rate and residual stress in the plating film of the composite structure prepared in accordance with the fourth embodiment of the present invention.

FIG. 10 shows that the residual stress in the expanding direction increases as the flow rate increases in the fourth embodiment (as in the third embodiment). Contrarily, when the flow rate is zero (that is, when the known immersing plating method is utilized), the residual stress is high in the shrinking direction (see FIG. 14).

As further shown in FIG. 10, the residual stress of a plating solution devoid of insoluble particles was measured at various flow rates and compared to the residual stress of a plating solution with insoluble particles. The plating solution containing the insoluble particles allows the resulting plating film 2 to have a greater residual stress in the expanding direction in comparison to the plating solution containing no insoluble particles.

Figure 11:
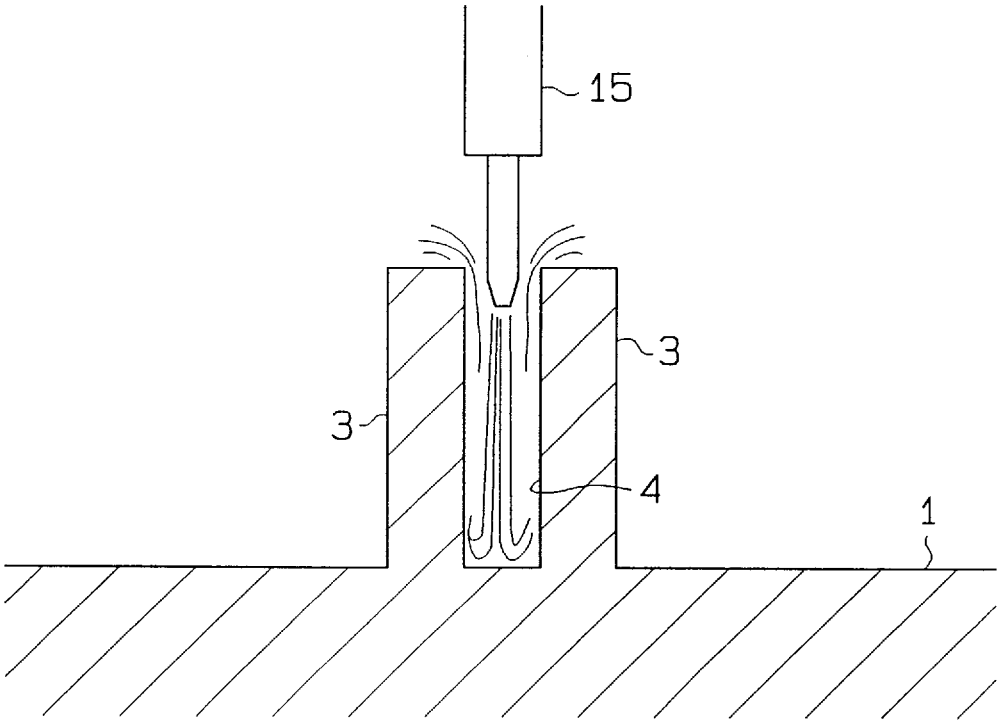
FIG. 11 is a schematic cross-sectional view illustrating a process for forming a composite structure containing a plating film disposed on a substrate formed from a metallic base material, the composite structure being prepared in accordance with a fifth embodiment of the present invention.

A fifth embodiment of the present invention will now be described with reference to FIGS. 1, 11 and 12. The principles of the fifth embodiment are substantially the same as the first to fourth embodiment. Therefore, only the difference will be described below.

Figure 12:
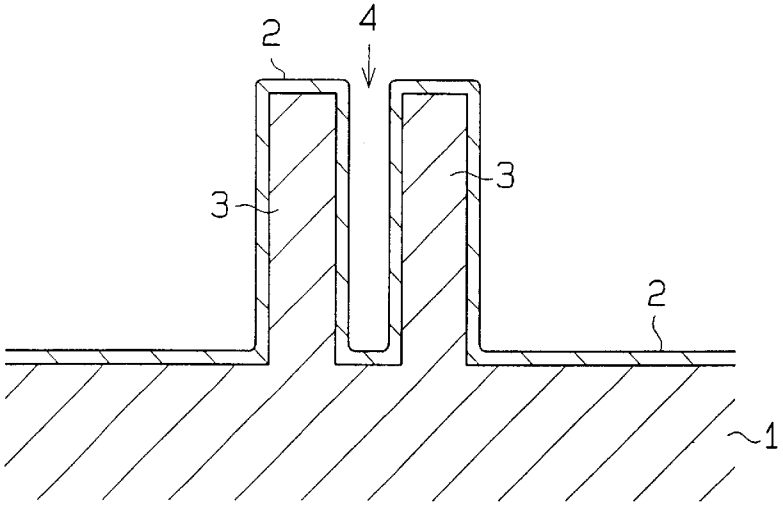
FIG. 12 is a schematic cross-sectional view illustrating substrate and the plating film prepared in accordance with the fifth embodiment of the present invention.
Figure 15:
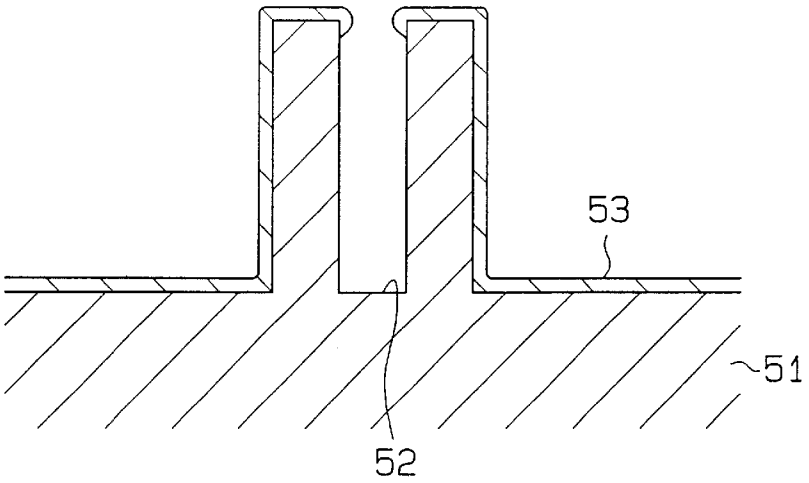
Fig.15 (Prior Art)
FIG. 15 is a schematic cross-sectional view illustrating a substrate formed from a metallic base material and a plating film disposed thereon as prepared in accordance with the conventional plating process.

FIG. 12 is a schematic cross-sectional view illustrating the plating film 2 formed on the surface of the substrate formed from an aluminum base material (hereinafter referred to as the base material). The plating film 2 is made, for example, with nickel.

The substrate 1 having at least a surface portion formed from a metallic base material according to the fifth embodiment has protrusions 3 and at least one groove 4 defined by the protrusions 3. According to the fifth embodiment, the plating film 2 is formed on the outer wall of the protrusions 3 and the inner walls of the groove 4.

The plating film 2 according to the fifth embodiment is formed by the plating apparatus described in the first embodiment. The same plating solution as the second embodiment is utilized in the fifth embodiment. Also, the solution temperature, pH and the current density are the same as in the second embodiment.

A plating method for forming the plating film 2 by the above plating apparatus will now be described.

The substrate 1 is placed on the table 14. Then the power supply 16 is actuated for operating the pump 18. The opening of the sub-valve 23 and the main valve 21 is appropriately adjusted. For forming the plating film 2 over the entire upper surface of the substrate 1, the table 14 can be moved relative to the nozzle 15. Alternatively, a plurality of nozzles 15 can be employed.

The pump 18 drives the plating solution through the communication passage 17 until the solution is discharged from the nozzle 15 and in turn received by the interfacing surface of the base material 1. The flow rate of the discharged plating solution is maintained relatively high, for example at least 4 m/s. When forming the plating film 2 on the inner wall of the groove 4, the plating solution is discharged from the nozzle 15 with the opening of the nozzle 15 directed towards and optionally inserted in the groove 4, as shown in FIG. 11.

Discharging the plating solution from the nozzle 15 electrically connects the nozzle 15 and the metallic base material of the surface portion of the substrate 1. The nozzle 15 serves as an anode and the metallic base material of the substrate 1 serves as a cathode. Applying voltage between the nozzle 15 and the metallic base material 1 allows the metal ions (e.g., nickel) in the metal plating solution to be deposited as the metal matrix. The deposited matrix forms the plating film 2.

The functions and effects of the fifth embodiment of the present invention will now be described.

According to the fifth embodiment, a strong plating film 2 is formed on the base material 1 by applying the metal plating solution to the base material 1 at an appropriate flow rate.

The flow rate of the discharged plating solution can be, for example, 4 m/s in the fifth embodiment. This ensures the above-discussed functions and effects are realized.

The conventional plating method immerses a base material in plating solution for forming a plating film. Unlike the conventional method, the fifth embodiment of the present invention forms a plating film by discharging plating solution from a nozzle and applying the solution to a base material. This results in the simplification of the production facility and reduction in manufacture costs.

In the fifth embodiment, the base material 1 has a groove 4 formed thereon. However, the plating solution is injected on the bottom of the groove 4 from the nozzle 15 and readily contacts the inner wall of the groove 4. Therefore, even if the groove 4 is narrow, the metal plating solution is readily applied to the inner walls of the groove 4, thereby depositing the plating film 2 over the portion of the substrate surface defining the groove 4.

In the fifth embodiment, the nozzle 15 is inserted in the groove 4 when injecting the plating solution on the inner wall thereof. This allows the injected plating solution to readily reach the bottom of the groove 4. The solution thereafter flows upward along the walls of the groove 4. The walls and bottom of the groove 4 are electrically connected with the nozzle 15 by the overflowed plating solution, accordingly. Therefore, the plating film 2 is formed on the entire surface of the groove 4.

According to this embodiment, since the nozzle 15 is made of electrically conductive material, the plating film 2 is formed on the vertical walls of the groove, as well as the bottom of the groove, on which the plating solution is directly discharged.

A sixth embodiment of the present invention will now be described with reference to FIGS. 11 to 14. The principles of the sixth embodiment are substantially the same as those of the fifth embodiment. Therefore, only the difference will be described below.

In this embodiment, silicon carbide insoluble particles are mixed in a metal plating solution to form a composite plating solution. The average particle size of the insoluble particles is, for example, about 300 $\mu$m, and the concentration of the insoluble particles in the solution is, for example, about 10 g/l.

In this embodiment, the same plating apparatus as employed in the fifth embodiment is used in the same manner as the fifth embodiment for forming plating film 2.

The functions and effects of the plating method according to the sixth embodiment will now be described.

According to the sixth embodiment, a strong plating film 2 is formed on at least the metallic base material surface portion of the substrate 1 by applying the composite plating solution on the surface of the base material at a certain flow rate. Therefore, the sixth embodiment has the same effects as the fifth embodiment.

In the sixth embodiment, the insoluble particles are dispersed in the plating solution. Discharging the plating solution on the base material 1 applies stress on the surface thereof. This stress ensures the above-described effects.

The base material 1 according to the sixth embodiment is made with aluminum. Therefore, oxide film is prone to be formed on the surface thereof. However, according to this embodiment, the oxide film is removed by impacting the insoluble particles contained in the discharged composite plating solution onto the base material. The conventional pretreatment step for removing the oxide film is thus omitted.

Although only six embodiments of the present invention have been described above, it should be apparent to those skilled in the art that the components and process steps and conditions of the above embodiments can be combined in various manners.

Several variations and modifications to the above-discussed method also can be practiced without departing from the spirit or scope of the invention. For example, the invention may be embodied in the following forms:

In the first embodiment as described above, the flow rate of composite plating solution is controlled to gradually decrease such that the co-deposited amount of the insoluble particles increases toward the outer surface thereof. However, the flow rate at the initial stage of the operation can be maintained substantially constant in order not to co-deposit the insoluble particles 4. In this case, the plating film 2 is formed only with the metal matrix 3. Alternatively, the flow rate can be controlled to initially be relatively low and thereafter gradually increase. In this case, the co-deposited amount of the insoluble particles 4 decreases toward the outer surface of the plating film 2.

In the first embodiment, nickel metal is used for forming the metal matrix 3. However, other metals can be substituted for the nickel, and other metals or metalloids can be used in addition to the nickel.

In the second embodiment, the metal composition of the alloy plating film 2 is controlled to change across the thickness of the film. However, it may be desirable to form different articles, with the articles comprising alloy plating films 2 that have metal compositions from one another. Production of these different articles can be accomplished by practicing the present invention without necessitating the provision of a separate metal plating solution for each article. For example, a certain flow rate can be employed for forming an alloy plating film on a first article, and the flow rate can be changed for forming an alloy plating film on another article. In this manner, the two articles have a plating film of different alloy compositions.

In the second embodiment, the flow rate is relatively slow at first and is gradually increased for changing the metal composition across the thickness of the alloy plating film 2. Conversely, the flow rate can be relatively high at first and thereafter be gradually decreased. Further, the flow rate can be controlled to increase and decrease alternately during formation of the plating film 2.

In the fourth embodiment, the plating film 2 is formed only with a metal matrix. However, the insoluble particles in the plating solution can be co-deposited in the plating film 2 by slowing the flow rate. The co-deposition of the insoluble particles is accompanied by additional advantages such as imparting an improved hardness and abrasion resistance to the plating film 2.

In the third and fourth embodiment, the metal plating solution is discharged at a certain flow rate high enough to allow the resulting film 2 to have residual stress in the expanding direction. However, the flow rate of the metal plating solution can be controlled such that the resulting film 2 has no residual stress. Even in this case, absorption of hydrogen gas in the film is suppressed. Since the film has no residual stress and little hydrogen gas, delamination of the plating film 2 from the substrate 1 is prevented.

In the third and fourth embodiments, nickel metals are used as the metal matrix 3. However, other metals can be used to form the matrix 3.

Figure 13:
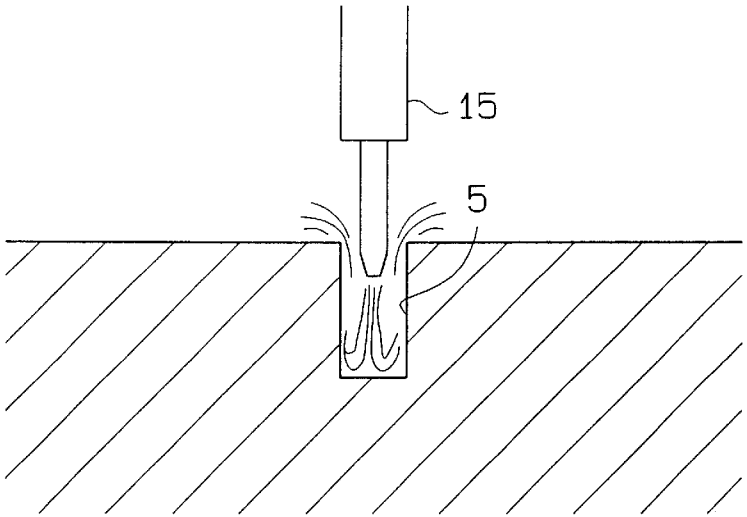
FIG. 13 is a schematic cross-sectional view illustrating a process for forming a composite structure having a substrate formed from a metallic base material and a plating film disposed thereon, the composite structure being prepared in accordance with another embodiment of the present invention.

In the fifth and sixth embodiment, the base material 1 has a pair of protrusions 3 and the groove 4 defined by the protrusions 3. However, as shown in FIG. 13, the present invention can be applied to a base material having a groove or recess 5 not defined by protrusions. The present invention also be applied to a base material having a hole or bore instead of grooves and recesses 4, 5.

In the fifth and sixth embodiments, the nozzle 15 is inserted in the grooves 4, 5. However, the nozzle 15 does not necessarily have to be inserted in the grooves 4, 5 as long as the nozzle applies plating solution to the bottom of the grooves.

In the sixth embodiment, the plating film 2 is formed only with the metal matrix. However, the insoluble particles in the plating solution can be co-deposited in the plating film 2 by slowing the flow rate of composite plating solution discharged from the nozzle 15. The co-deposition of insoluble particles is accompanied by additional advantages such as the imparting of an improved hardness and abrasion resistance to the plating film 2.

In the first to sixth embodiments, the plating solution is discharged from the nozzle 15. However, the plating solution may be injected in different manner that is capable of applying the plating solution to the base material at an appropriate flow rate. For example, the plating solution may flow in a cascade manner onto the base material.

Further, in the first to sixth embodiments, the plating solution and insoluble particles are not restricted to the specific materials discussed above in connection with the description of these embodiments; rather, the specific materials discussed above have been provided for explanatory purposes and are not limiting to the scope of the present invention.

Furthermore, in the first to sixth embodiment, aluminum is used as the base material 1. However, the present invention is applicable to any metal-containing base material that forms an oxide or oxide film thereon. For example, the present invention may be applicable to an iron base material.

In the first to sixth embodiment, the substrate formed from the metal base material can be attached to the surface of a non-metal subject, or can contain a portion that is not metal based.

It will thus be seen that the objectives and principles of this invention have been fully and effectively accomplished. It will be realized, however, that the foregoing preferred specific embodiments have been shown and described for illustrative and not restrictive purposes and are subject to change without departure from such principles. Therefore, this invention includes all variations, modifications, and improvements encompassed within the spirit and scope of the appended following claims.

What is claimed is:

1. A method of making a composite structure comprising a composite plating film disposed on a substrate, said method comprising the steps of:

providing a substrate having at least a surface portion formed from at least one metallic base material;

discharging a composite plating solution comprising ions of at least one metal and insoluble particles dispersed in the composite plating solution from at least one discharging device at a set flow rate and impacting the discharged composite plating solution to the surface portion of the substrate;

abrading the surface portion of the substrate with the insoluble particles during at least a portion of said discharging and impacting steps;

decreasing the flow rate of the composite plating solution after abrading the surface portion of the substrate; and applying a voltage between the substrate and the discharging device, which are electrically connected to each other by the discharged composite plating solution, and depositing a composite plating film on the surface portion of the substrate, the composite plating film including a metal matrix formed from the metal ions and the insoluble particles co-deposited with the metal matrix.

2. A method according to claim 1, wherein the insoluble particles dispersed in the composite plating solution include particles of larger size for abrading an outer surface of the substrate and particles of smaller size that are co-deposited in the composite plating film.

3. A method according to claim 2, wherein the flow rate of the composite plating solution during at least a portion of said abrading step is not less than 4 m/s and is less than a flow rate that deforms the surface portion of the substrate.

4. A method according to claim 2, wherein said decreasing step involves gradually and continuously decreasing the flow rate of the discharged composite plating solution.

5. A method of making a composite structure comprising a composite plating film disposed on a substrate, said method comprising the steps of:

providing a substrate having at least a surface portion formed from at least one metallic base material;

discharging a composite plating solution comprising first ions of at least one metal, second ions of at least one member selected from the group consisting of at least one metal and at least one metalloid, and insoluble particles dispersed in the composite plating solution from at least one discharging device at a set flow rate, the first ions being different from the second ions;

impacting the discharged plating solution to the surface portion of the substrate;

applying a voltage between the substrate and the discharging device, which are electrically connected to each other by the discharged composite plating solution, and depositing a composite plating film on the surface portion of the substrate, the composite plating film including an alloy matrix formed from the first and second ions and having the insoluble particles co-deposited with the alloy matrix; and controlling the flow rate of the discharged composite plating solution during at least a portion of said applying step to change the composition of the composite plating film, wherein said controlling step involves continuously changing the flow rate of the composite plating solution during said applying and depositing steps, wherein said controlling step is performed in such a manner that the composite plating film has a hardness that increases from a first surface proximal to the surface portion of the substrate to an opposing second surface of the composite plating film, and wherein said controlling step is performed in such a manner that the composite plating film has an adhesive strength that increases from the second surface of the composite plating film toward the first surface of the composite plating film.

6. A method according to claim 5, wherein the composite plating film contains at least nickel and phosphorus as the first and second ions, respectively.

7. A method of making a composite structure comprising a composite plating film disposed on a substrate, said method comprising the steps of:

providing a substrate having at least a surface portion formed from at least one metallic base material;

discharging a composite plating solution containing ions of at least one metal and insoluble particles dispersed in the composite plating solution from at least one discharging device and impacting the discharged composite plating solution against the surface portion of the substrate;

applying a voltage between the substrate and the discharging device, which are electrically connected to each other by the composite plating solution, and depositing a composite plating film on the surface portion of the substrate such that the deposited composite plating film has a residual stress in the expanding direction; and imparting a stress to at least the surface portion of the substrate with the insoluble particles throughout said applying and depositing steps, wherein the composite plating film includes a metal matrix formed from the metal ions and the insoluble particles co-deposited with the metal matrix.

8. A method according to claim 7, wherein the flow rate of the plating solution discharged from the discharging device is not less than 4 m/s and less than a flow rate that deforms the metallic base material.

9. A method according to claim 8, wherein the at least one metallic base material is aluminum.

10. A method of making a composite structure comprising a composite plating film disposed on a substrate, said method comprising the steps of:

providing a substrate having at least a surface portion formed from at least one metallic base material having at least one recess therein;

discharging a composite plating solution comprising first ions of at least one metal, second ions of at least one member selected from the group consisting of at least one metal and at least one metalloid, and insoluble particles dispersed in the composite plating solution from at least one discharging device and impacting the discharged composite plating solution to at least a bottom portion of the recess at a set flow rate;

applying a voltage between the substrate and the discharging device, which are electrically connected to each other by the composite plating solution, and depositing composite plating film on the surface portion of the substrate, the composite plating film including an alloy matrix formed from the first and second ions and having the insoluble particles co-deposited with the alloy matrix; and controlling the flow rate of the discharged composite plating solution during at least a portion of said applying step to change the composition of the composite plating film, wherein said controlling step involves continuously changing the flow rate of the composite plating solution during said applying and depositing steps, wherein said controlling step is performed in such a manner that the composite plating film has a hardness that increases from a first surface proximal to the surface portion of the substrate to an opposing second surface of the composite plating film, and wherein said controlling step is performed in such a manner that the composite plating film has an adhesive strength that increases from the second surface of the composite plating film toward the first surface of the composite plating film.

11. A method according to claim 10, wherein said process further comprises imparting a stress to at least the surface portion of the substrate with the insoluble particles during at least a portion of said impacting step.

12. A method according to claim 11, wherein the flow rate of the composite plating solution discharged from the discharging device during said abrading step is not less than 4 m/s and less than a flow rate that deforms the metallic base material.

13. A method according to claim 10, wherein the discharging device comprises an electrically conductive material.

14. A method according to claim 13, wherein the electrically conductive discharging device comprises a nozzle having an opening and wherein the method further comprises inserting the opening of the nozzle in the recess during at least a portion of said discharging step.

* * * * *